US005162809A

United States Patent [19]

Wu

[11] Patent Number: 5,162,809

[45] Date of Patent: Nov. 10, 1992

[54] POLARIZATION INDEPENDENT FREQUENCY SELECTIVE SURFACE FOR DIPLEXING TWO CLOSELY SPACED FREQUENCY BANDS

[75] Inventor: Te-Kao Wu, Rancho Palos Verdes, Calif.

[73] Assignee: Hughes Aircraft Company, Los Angeles, Calif.

[21] Appl. No.: 601,844

[22] Filed: Oct. 23, 1990

[51] Int. Cl.[5] ..... H01Q 15/02

[52] U.S. Cl. ..... 343/909; 343/753

[58] Field of Search ..... 343/909, 753, 907, 754, 343/755, 908, 781 P, 779; 333/202, 204

[56] References Cited

U.S. PATENT DOCUMENTS

| | | | |
|---|---|---|---|
| 3,148,370 | 9/1964 | Bowman | 343/909 |
| 4,125,841 | 11/1978 | Munk | 343/909 |
| 4,656,487 | 4/1987 | Sureau et al. | 343/909 |
| 4,684,954 | 8/1987 | Sureau et al. | 343/909 |
| 4,785,310 | 11/1988 | Rosen | 343/909 |
| 4,814,785 | 3/1989 | Wu | 343/909 |

OTHER PUBLICATIONS

Langly et al., "Double Square Frequency Selective Surfaces and Their Equivalent Circuit", Electronics Letters, Aug. 18, 1983, vol. 19, No. 17.

*Primary Examiner*—Rolf Hille
*Assistant Examiner*—Hoanganh Le
*Attorney, Agent, or Firm*—Leonard A. Alkov; Wanda K. Denson-Low

[57] ABSTRACT

A frequency selective surface suitable for separating two closely adjacent frequency band microwave signals. The frequency selective surface comprises a symmetrical array of discreet open center outer conductor elements and an open center conductor element centered in spaced relationship within each of the outer conductor elements. Both square loop and circular loop conductor elements may be employed. The spacing between corresponding parts of the conductor elements is periodic. The spacing between adjacent edges of the outer conductor elements and the spacing between adjacent edges of the outer and inner conductor elements are maintained within predetermined ratios of the wavelength of a microwave signal to be reflected by the surface providing a frequency selective surface in which the ratio of transmitted microwave signals to the frequency of reflected microwave signals is 1.15.

18 Claims, 2 Drawing Sheets

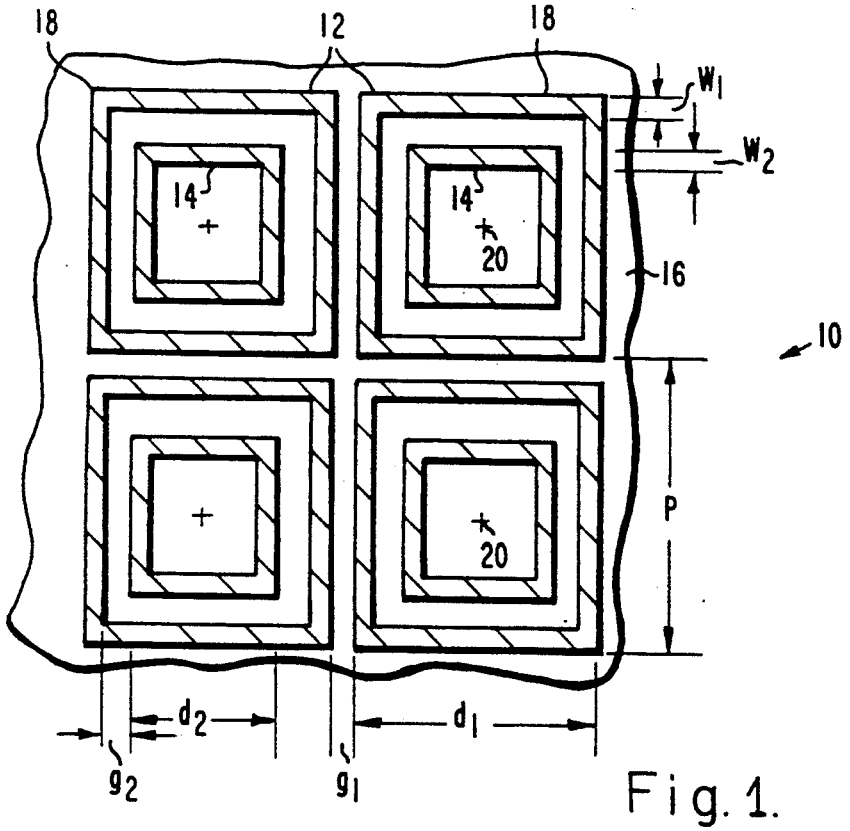
Fig. 1.
Fig. 2.
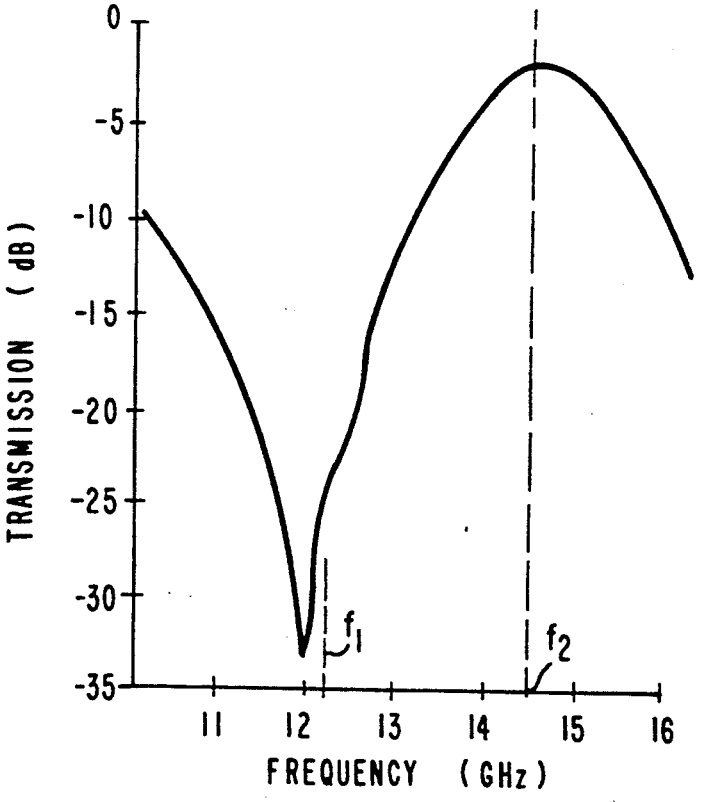

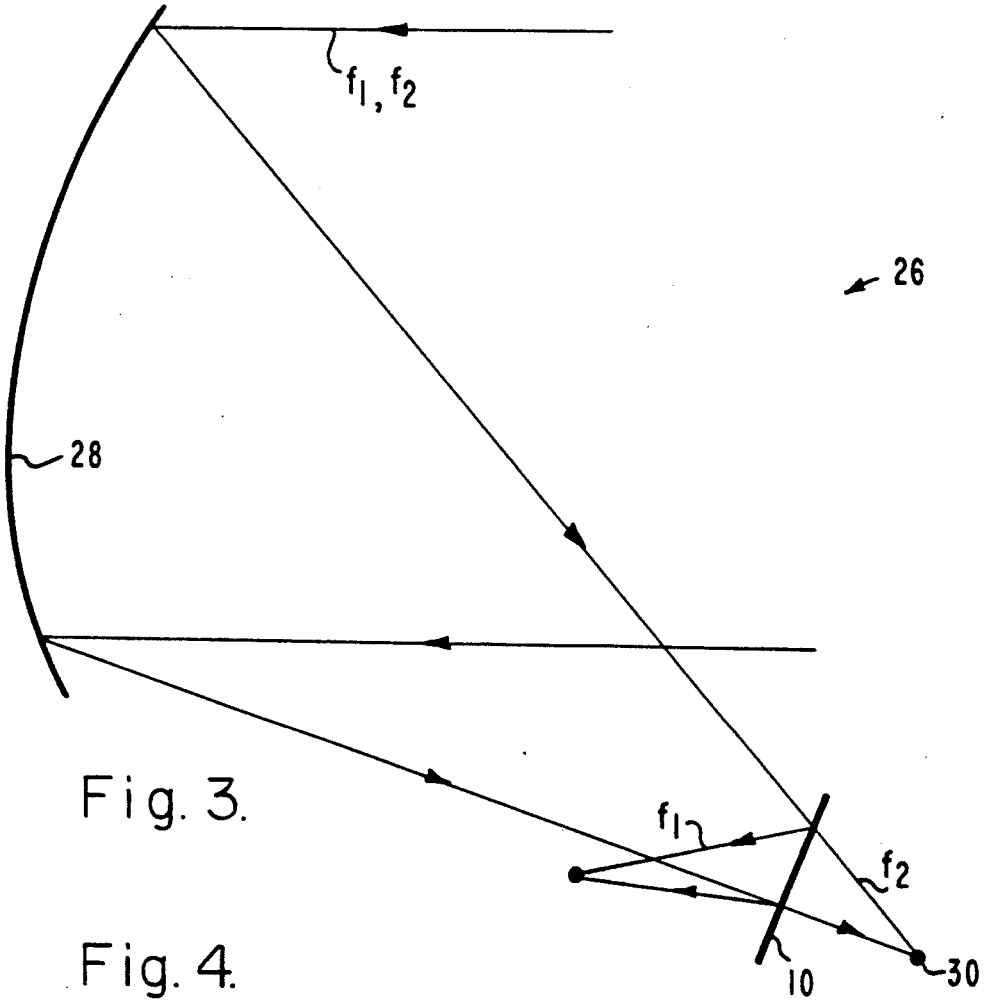
Fig. 3.
Fig. 4.
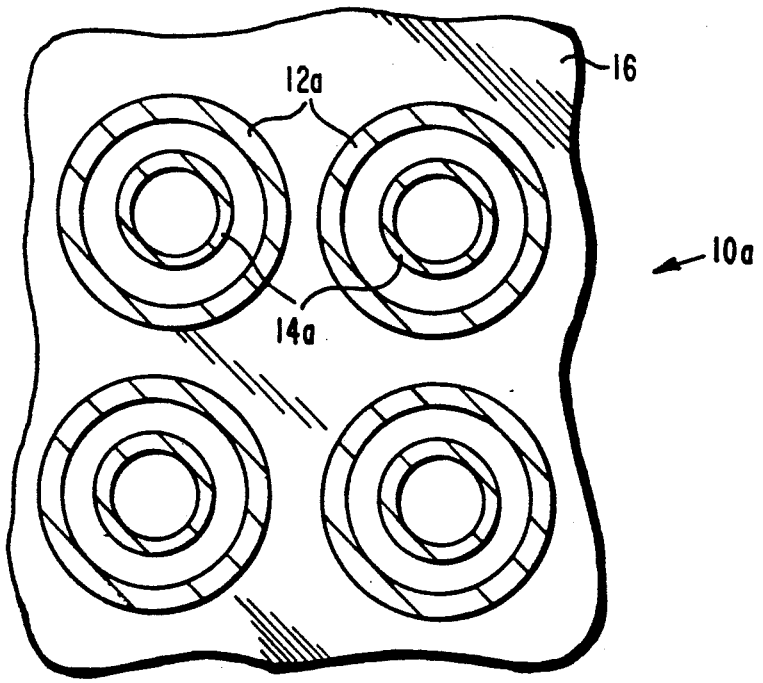

POLARIZATION INDEPENDENT FREQUENCY SELECTIVE SURFACE FOR DIPLEXING TWO CLOSELY SPACED FREQUENCY BANDS

BACKGROUND

The invention relates generally to frequency diplexers for separating coincident microwave signals of different frequency, and in particular, to a double square loop frequency selective surface which provides polarization independent separation of microwave signals in two closely adjacent frequency bands.

A diplexer is, in general terms, any device utilized to separate coincident signals of different frequency. In microwave communication systems a diplexer can be provided in the form of a frequency selective surface or a dichroic surface. The frequency selective surface typically comprises a grid or an array of conductor elements formed on a dielectric substrate. The geometric configuration of the conductor elements and their connection or non-connection produces a surface which exhibits transmission resonance to incident microwave signals within a predetermined frequency band. Typically, the frequency selective surface is used in conjunction with a primary paraboloidal reflector. The frequency selective surface is positioned between the primary reflector and its focal point. Signals of the resonant frequency are reflected by the frequency selective surface while other signals are transmitted thereby. This effectively separates the signals for further processing.

Examples of such prior art frequency selective surfaces can be found in U.S. Pat. No. 4,125,841 to Munk which utilizes multiple aligned screens to provide a frequency selective surface having a desired angular transmission characteristic. Such multiple layer screens have the disadvantage of additional weight and bulk required by the multiple layers and increased cost as a result of precise alignment requirements. Single layer frequency selective surfaces are disclosed in U.S. Pat. No. 4,785,310 to Rosen and U.S. Pat. No. 4,814,785 to Te-Kao Wu, both of which are assigned to assignee of the present invention. These patents disclose frequency selective surfaces which overcome the need for multiple screens and their attendant complexity.

Frequency selective surfaces comprised of an array of double square loops are disclosed in the patent entitled "Double-Square Frequency Selective Surfaces and their Equivalent Circuit," by Langly and Parker, *Electronics Letters*, Aug. 18, 1983, Vol. 19, No. 17. In this paper, a frequency selector surface capable of separating signals having a frequency ratio of as low as about 1.4 is derived with the frequencies of the reflected and transmitted signals being a function of the perimetral dimensions of the inner and outer square loops. The paper discloses a mathematical model and equivalent circuit for a double square loop frequency selective surface. The resonant and transmitted frequencies of the surface are described as a function of the perimetral dimensions of the square loop conductor elements.

In many microwave communication systems, it is necessary to separate microwave signals in closely adjacent bands, the Ka and Ku transmit and receive bands, for example. In such applications, the ration of the two frequency bands is in the order of 1.15. There therefore exists a need for a frequency selective surface that can be provided as a single layer surface which exhibits a sharp cut off transmission response allowing separation of frequency bands having a ration of about 1.15 and which has a symmetrical configuration making the surface polarization independent.

It is therefore an objective of the invention to provide an improved frequency selective surface. Another objective of the invention is to provide a frequency selective surface comprised of a symmetrical array of conductor elements that is polarization independent. Yet another objective of the invention is to provide a frequency selective surface which exhibits a very sharp frequency band pass characteristic enabling separation of closely adjacent frequency band signals. Another objective of the invention is to provide a frequency selective surface that exhibits sharp frequency cut off characteristics with a surface comprised of a single layer of conductor elements. Still another objective of the invention is to provide a frequency selective surface which can separate frequency bands having a frequency ratio of 1.15.

SUMMARY OF THE INVENTION

Broadly, the invention is a frequency selective surface for diplexing microwave signals in closely adjacent frequency bands. The surface comprises a microwave transmissive dielectric substrate supporting an array of periodically spaced open center outer conductor elements. An open center inner conductor element is secured in centered spaced relationship within the open center of each outer conductor element. Both square loop and circular loop conductor elements may be employed. The spacing between adjacent edges of the outer conductor elements is greater than or equal to 0.044 times the periodicity of the surface. The spacing between adjacent edges of the inner and outer conductor elements is less than or equal to 0.018 times the periodicity of the surface. A reflected to transmitted frequency ratio of 1.15 is achieved.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a fragmentary plan view illustrating the configuration of square conductor elements of a frequency selective surface in accordance with the invention;

FIG. 2 is a diagram showing the transmission characteristics of a frequency selective surface in accordance with the invention;

FIG. 3 is a plan view of a typical microwave reflector assembly incorporating a frequency selective surface in accordance with the invention; and FIG. 4 is a fragmentary plan view illustrating a configuration of circular conductor elements of a frequency selective surface in accordance with the invention.

DETAILED DESCRIPTION

Referring now to the drawings, a fragmentary portion of a frequency selective surface 10 is shown in FIG. 1. The frequency selective surface 10 comprises an array of outer conductor elements 12 and inner conductor elements 14 supported on a dielectric substrate 16. Typically, the substrate 16 comprises a thin film of a polyimide material such as Kapton, for example. The thickness of the substrate 16 is kept to a minimum to minimize the effects of the dielectric material on the electrical properties of the frequency selective surface 10. In a working embodiment, the substrate is fabricated using a 0.001 inch thick Kapton sheet.

The outer and inner conductor elements 12, 14 are made of an electrically conductive material such as copper. These elements may be formed by etching a thin copper film adhered to the surface of the substrate 16.

The outer conductor elements 12 comprise a multiplicity of discreet open centered square loops. The outer conductor elements 12 are arranged in a periodic array. Corresponding points on the outer conductor 12, such as corners 18, are displaced about one-quarter wavelength apart. The wavelength is the wavelength of the particular frequency signal to be reflected by the surface 10 the surface resonant frequency. The array of elements 12 is symmetrical. The elements 12 are both symmetrical in shape (square) and are arranged in equally spaced periodic intervals in both the vertical and horizontal directions (as viewed in the drawing).

The inner conductor elements 14 are also open center square loops having their centers 20 coexistent with the centers of the outer conductor elements 12. The inner conductor elements are secured in centered, spaced relationship within the outer conductor elements 12.

To provide a frequency selective surface 10 having a sharp transition in its transmission characteristic, the spacing $g_1$ between the adjacent edges of adjacent ones of the outer conductor elements 12 and the spacing $g_2$ between adjacent edges of the outer and inner connector elements 12, 14 is critical. It has been determined that the spacing $g_1$ of the outer conductor elements 12 divided by the periodicity P of the surface 10 must be maintained at a value greater than or equal to 0.044, and the spacing $g_2$ between the outer and inner connector elements 12, 14 divided by the periodicity P of the surface 10, must be maintained at a value of less than or equal to 0.018. This produces a surface 10 for which the ratio of the frequency of signals transmitted by the surface 10 with substantially no attenuation and the frequency of signals reflected by the surface 10 at a level of nearly 100% is achieved. Further, the square within a square configuration of the conductor elements 12, 14 is symmetrical and the frequency selective surface 10 functions equally for horizontal, vertical and circularly polarized signals.

Such a frequency selective surface 10 may be incorporated in a microwave reflector assembly such as the assembly 26 shown diagrammatically in FIG. 3. The assembly includes a primary reflector 28, typically of paraboloidal configuration, having a primary focal point 30. The frequency selective surface 10 is interposed between the primary reflector 28 and its focal point 30. Microwave signals of frequency $f_1$, the resonant frequency, are substantially reflected. Conversely, closely adjacent frequency signals, denominated $f_2$ in FIG. 3, pass through the frequency selective surface 10 with substantially no attenuation.

FIG. 4 shows a fragmentary plan view illustrating a configuration of circular conductor elements **12*a*, 14*a* of a frequency selective surface 10*a* disposed on a substrate 16 in accordance with the invention. The various dimensions shown in FIG. 1 are applicable to the frequency selective surface 10*a* of FIG. 4. The operation of the frequency selective surface 10*a* is substantially the same as the frequency selective surface 10 of FIG. 1**.

In a specific working embodiment of the invention, the surface 10 shown in FIG. 1 was tested as a diplexer for separating the Ku transmit and receive bands, 11.7 to 11.2 GHz and 14.0 to 14.5 GHz, respectively. The wavelength of the signals and dimensions of the array are as follows: the periodicity $P=5.0$ mm, the outer conductor width $W_1=0.15$ mm, the outer conductor side $d_1=4.78$ mm, the space between outer conductor elements $g_1=0.22$ mm, the inner conductor width $W_2=0.15$ mm, the inner conductor side $d_2=4.3$ mm, and the space between inner and outer conductor elements $g_2=0.09$ mm.

These dimensions provide a value of $g_1/P \geqq 0.044$ and $g_2/P \leqq 0.018$. The transmission characteristic for this surface 10 is shown in FIG. 2. The resonant frequency $f_1$ is 12.2 GHz and transmission of signals with 0.5 db attenuation (89% transmission) occur at a frequency $f_2$ of 14.0 GHz. The frequency ratio $f_2/f_1$ is 1.15.

To further optimize the transmission characteristic, it is necessary to adjust the widths $W_1$ and $W_2$ of the conductor elements 12, 14. These values can be derived by either trial and error or with an appropriate computer program. These dimensions are derived as a function of the frequency of signals to be reflected and transmitted.

Thus there has been described a new and improved frequency selective surface for use in separating two closely adjacent frequency band microwave signals having a frequency ratio as low as 1.15. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A frequency selective surface with an associated periodicity for diplexing signals in closely adjacent frequency bands, said surface comprising:

a substrate;

a symmetrical array of periodically spaced open center outer conductor elements disposed on the substrate;

a symmetrical array of periodically spaced opened center inner conductor elements disposed on the substrate in centered spaced relationship within each of the outer conductor elements;

wherein the space between adjacent edges of adjacent ones of the outer conductor elements divided by the periodicity of the surface is no less than 0.044, and the space between adjacent edges of the outer and inner conductor elements divided by the periodicity of the surface is no greater than 0.018.

2. The surface of claim 1 wherein the distance between corresponding points of adjacent outer and inner connector elements of the array is equal to about one-quarter of the wavelength of the resonant frequency of the surface.

3. The frequency selective surface of claim 2 wherein the width of the conductors of the outer and inner conductor elements is predetermined to be a function of the resonant frequency of the surface.

4. The surface of claim 3 wherein the thicknesses of the substrate and of the outer and inner conductor elements are small in proportion to perimetral dimensions thereof.

5. The surface of claim 4 wherein the outer and inner conductor elements are formed of an etched copper film bonded to the surface of a polyimide substrate.

6. The surface of claim 5 wherein the thickness of the polyimide substrate is no greater than 0.001 inch.

7. The surface of claim 1 wherein the array of periodically spaced open center outer conductor elements comprises an array of periodically spaced open center square loop outer conductor elements.

8. The surface of claim 1 wherein the array of periodically spaced open center inner conductor elements comprises an array of periodically spaced open center square loop inner conductor elements.

9. A frequency selective surface with an associated periodicity for diplexing microwave signals in closely adjacent frequency bands, said surface comprising:

a microwave transmissive substrate;

a symmetrical array of periodically space open center outer conductor elements disposed on the substrate;

a symmetrical array of periodically spaced opened center inner conductor elements disposed on the substrate in centered spaced relationship within each of the outer conductor elements;

wherein the space between adjacent edges of adjacent ones of the outer conductor elements divided by the periodicity of the surface is no less than 0.044, and the space between adjacent edges of the outer and inner conductor elements divided by the periodicity of the surface is no greater than 0.018, and wherein the distance between corresponding points of adjacent outer and inner connector elements of the array is equal to about one-quarter of the wavelength of the resonant frequency of the surface.

10. The frequency selective surface of claim 9 wherein the width of the conductors of the outer and inner conductor elements is predetermined to be a function of the resonant frequency of the surface.

11. The surface of claim 10 wherein the thicknesses of the substrate and of the outer and inner conductor elements are small in proportion to perimetral dimensions thereof.

12. The surface of claim 11 wherein the outer and inner conductor elements are formed of an etched copper film bonded to the surface of a polyimide substrate.

13. The surface of claim 12 wherein the thickness of the polyimide substrate is no greater than 0.001 inch.

14. The surface of claim 9 wherein the array of periodically spaced open center outer conductor elements comprises an array of periodically spaced open center square loop outer conductor elements.

15. The surface of claim 9 wherein the array of periodically spaced open center inner conductor elements comprises an array of periodically spaced open center square loop inner conductor elements.

16. A frequency selective surface with an associated periodicity for diplexing microwave signals is closely adjacent frequency bands, said surface comprising:

a microwave transmissive polyimide substrate;

a symmetrical array of periodically spaced open center outer conductor elements disposed on the substrate;

a symmetrical array of periodically spaced open center inner conductor elements disposed on the substrate in centered spaced relationship within each of the outer conductor elements;

wherein the space between adjacent edges of adjacent ones of the outer conductor elements divided by the periodicity of the surface is no less than 0.044, and the space between adjacent edges of the outer and inner conductor elements divided by the periodicity of the surface is no greater than 0.018.

17. The surface of claim 16 wherein the array of periodically spaced open center outer conductor elements comprises an array of periodically spaced open center square loop outer conductor elements.

18. The surface of claim 16 wherein the array of periodically spaced open center inner conductor elements comprises an array of periodically spaced open center square loop inner conductor elements.

* * * * *